US009194201B2

(12) United States Patent
Simson et al.

(10) Patent No.: US 9,194,201 B2
(45) Date of Patent: Nov. 24, 2015

(54) SYSTEM AND METHOD FOR DEPLOYING A DOWNHOLE CASING PATCH

(75) Inventors: James A. Simson, Meadows Place, TX (US); Ronald G. Schmidt, Tomball, TX (US)

(73) Assignee: Smith International, Inc., Houston, TX (US)

( * ) Notice: Subject to any disclaimer, the term of this patent is extended or adjusted under 35 U.S.C. 154(b) by 802 days.

(21) Appl. No.: 13/450,941

(22) Filed: Apr. 19, 2012

(65) Prior Publication Data

US 2012/0267099 A1 Oct. 25, 2012

Related U.S. Application Data

(60) Provisional application No. 61/477,350, filed on Apr. 20, 2011.

(51) Int. Cl.

| | |
|---|---|
| ***E21B 29/10*** | (2006.01) |
| ***E21B 23/01*** | (2006.01) |
| ***E21B 43/10*** | (2006.01) |

(52) U.S. Cl.

CPC ..... *E21B 29/10* (2013.01); *E21B 23/01* (2013.01); *E21B 43/103* (2013.01)

(58) Field of Classification Search

CPC ..... E21B 29/10; E21B 43/103; E21B 43/106; E21B 23/01

See application file for complete search history.

(56) References Cited

U.S. PATENT DOCUMENTS

| | | | |
|---|---|---|---|
| 1,233,888 | A | 9/1916 | Leonard |
| 3,167,122 | A | 1/1965 | Lang |
| 3,191,680 | A | 6/1965 | Vincent |
| 3,203,451 | A | 8/1965 | Vincent |
| 3,286,992 | A | 11/1966 | Armeniades et al. |
| 3,981,172 | A | 9/1976 | Hess et al. |
| 4,027,857 | A | 6/1977 | Cunningham |
| 4,548,509 | A | 10/1985 | Parrott et al. |
| 5,195,584 | A | 3/1993 | Basinger, Jr. |
| 5,404,950 | A | 4/1995 | Ng et al. |
| 5,582,251 | A | 12/1996 | Bailey et al. |
| 5,785,120 | A | 7/1998 | Smalley et al. |
| 5,823,524 | A | 10/1998 | Kawada |
| 6,142,230 | A | 11/2000 | Smalley et al. |
| 6,543,536 | B2 | 4/2003 | Dewey et al. |
| 6,775,894 | B2 | 8/2004 | Hardin |
| 6,899,183 | B2 | 5/2005 | Dewey et al. |
| 7,090,005 | B2 | 8/2006 | Smith, Jr. et al. |
| 7,114,559 | B2 | 10/2006 | Sonnier et al. |

(Continued)

FOREIGN PATENT DOCUMENTS

| | | |
|---|---|---|
| EP | 1491718 | 6/2006 |

OTHER PUBLICATIONS

International Search Report and Written Opinion of PCT Application No. PCT/US2012/034215 dated Nov. 5, 2012: pp. 1-9.

*Primary Examiner* — William P Neuder
*Assistant Examiner* — Kristyn Hall

(57) ABSTRACT

A casing patch and methods for using same are provided. The patch can include a hollow, substantially tubular body. An opening can be formed in the body. A tapered slot can be formed in the body below the opening. A width of the tapered slot proximate the opening can be greater than the width of the tapered slot distal the opening. The tapered slot can be adapted to receive a tapered wedge and expand radially outward as the tapered wedge slides within the tapered slot and away from the opening.

20 Claims, 19 Drawing Sheets

(56) References Cited

U.S. PATENT DOCUMENTS

| | | | |
|---|---|---|---|
| 7,128,146 | B2 | 10/2006 | Baugh et al. |
| 7,360,592 | B2 | 4/2008 | McMahan |
| 7,367,391 | B1 | 5/2008 | Stuart et al. |
| 7,428,928 | B2 | 9/2008 | Cho et al. |
| 7,438,133 | B2 | 10/2008 | Brisco |
| 7,469,750 | B2 | 12/2008 | Carr |
| 7,543,637 | B2 | 6/2009 | Green et al. |
| 7,543,639 | B2 | 6/2009 | Emerson |
| 7,546,881 | B2 | 6/2009 | Lloyd et al. |
| 7,549,469 | B2 | 6/2009 | Garcia |
| 7,559,365 | B2 | 7/2009 | Watson et al. |
| 7,621,323 | B2 | 11/2009 | Reavis et al. |
| 7,757,774 | B2 | 7/2010 | Ring |
| 7,789,138 | B2 | 9/2010 | McGarian et al. |
| 7,861,775 | B2 | 1/2011 | Palmer et al. |
| 2004/0016544 | A1 | 1/2004 | Braddick |
| 2008/0053656 | A1 | 3/2008 | Lynde |
| 2010/0258311 | A1 | 10/2010 | Craig et al. |

SYSTEM AND METHOD FOR DEPLOYING A DOWNHOLE CASING PATCH

CROSS-REFERENCE TO RELATED APPLICATIONS

This application claims the benefit of and priority to U.S. provisional patent application having Ser. No. 61/477,350 that was filed on Apr. 20, 2011, which is incorporated by reference herein in its entirety.

BACKGROUND

The present disclosure relates generally to a system and method for deploying a downhole casing patch.

Oil and gas wells are ordinarily completed by cementing metallic casing strings in the wellbore. During the drilling, completion and production phase, operators may find it necessary to perform remedial work, repair and maintenance to the casing. For example, the casing is commonly perforated using an explosive charge to evaluate various formations. In addition to the intended perforations, unintentional holes or defects may also be created in the casing. This can allow a leak to develop in the casing permitting the loss of well fluids to a low pressure, porous zone outside the casing, or permit an unwanted formation fluid, such as water, to enter the well. Regardless of the specific application, it is often necessary to deploy a patch to a downhole casing to seal the wellbore from the external formation.

Numerous methods have been developed over the years to deploy patches in casing. One method includes coating a longitudinally corrugated liner with a thin layer of epoxy resin (or other cementing material) and a glass fiber cloth prior to deployment in the wellbore. The coated liner is run into the wellbore (to the damaged area) on a tubing string and then expanded against the casing by forcing an expander device (e.g., a cone) through the liner. While this methodology has been commercially utilized, application of the epoxy resin can be problematic. For example, engagement of the coated liner with the wellbore wall (especially in deviated wells) can cause a loss of the epoxy resin and fiber materials during deployment. Such loss tends to result in an inadequate seal between the patch and the casing. Moreover, the cure cycle of the epoxy begins when mixing is complete. As such, any delay during deployment of the patch can result in premature curing of the epoxy.

Another method includes a metallic tubular that is hydraulically or mechanically expanded into contact with the casing to create a mechanical seal that relies on the contact stress between the expanded tubular and the casing. The metallic tubular is made of a highly compliant material to improve the contact resistance and therefore better seal the damaged section. This tends to require large pressures to expand the tubular and a tubular patch fabricated from an expensive alloy to obtain an effective seal.

Swage style patches are also known in the art and make use of hydraulically or mechanically deformable swages to seal the upper and lower ends of the patch. A conventional threaded tubular patch is deployed between and coupled with the swages. The damaged section is thereby straddled and isolated by the swages and tubular. While swage style patches provide an effective seal, they also tend to create a restriction in the wellbore, since the tubular patch is not expanded.

Epoxy only patches are also known in the art and make use of an epoxy resin that is pumped downhole to the damaged section. After curing, the wellbore is re-drilled to remove any excess epoxy. While such patches are sometimes effective, they rely only on the properties of the epoxy for their strength. As such, the epoxy-only patch is typically ineffective at high pressures.

There remains a need in the art, therefore, for new casing patches and methods for deploying patches in a subterranean cased wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Systems and methods for repairing a casing in a wellbore are provided. The system can include a hollow, substantially tubular body. An opening can be formed in the body. A tapered slot can be formed in the body below the opening. A width of the tapered slot proximate the opening can be greater than the width of the tapered slot distal the opening. The tapered slot can be adapted to receive a tapered wedge and to expand radially outward as the tapered wedge slides within the tapered slot and away from the opening.

The method can include running a patch into a wellbore. The patch can include a hollow, substantially tubular body. An opening can be formed in the body, and a tapered slot can be formed in the body below the opening. A width of the tapered slot proximate the opening can be greater than the width of the tapered slot distal the opening. At least a portion of the patch can be anchored to an inner surface of the casing with an anchoring tool disposed at least partially within the patch. The patch can be expanded radially outward with an expansion tool after the portion of the patch has been anchored to the inner surface of the casing.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only exemplary embodiments and are therefore not to be considered limiting of its scope, for the invention can admit to other equally effective embodiments.

FIGS. 3 and 3A-1 to 3C-2 depict cross-sectional views of an illustrative tool string and patch, according to one or more embodiments disclosed.

FIGS. 7, 7A-1, 7A-2, and 7B depict cross-sectional views of an illustrative injection tool, according to one or more embodiments disclosed.

FIGS. 8, 8A-1, 8A-2, and 8B depict cross-sectional views of an illustrative expansion tool, according to one or more embodiments disclosed.

FIGS. 9, 9A-1, and 9A-2 depict a cross-sectional views of another illustrative expansion tool, according to one or more embodiments disclosed.

DETAILED DESCRIPTION

Figure 1:
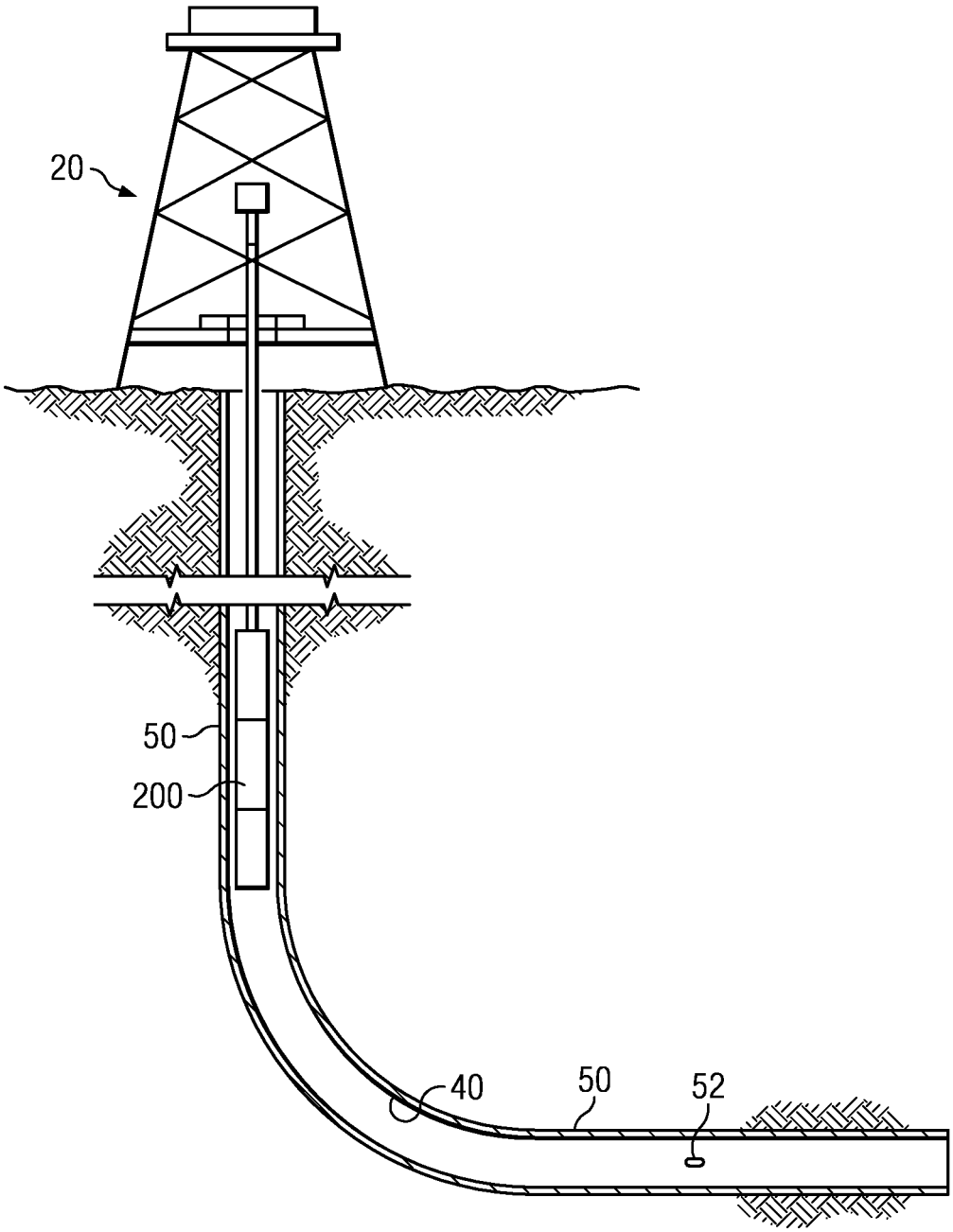
FIG. 1 depicts a cased wellbore having a tool string disposed therein, according to one or more embodiments disclosed.

FIG. 1 depicts a cased wellbore 40 having a tool string 200 disposed therein, according to one or more embodiments. The wellbore 40 can be disposed proximate a subterranean oil or gas formation. The wellbore 40 can be at least partially cased with one or more casing strings or casings 50. The casing 50 can include a defect 52 (e.g., a perforation, crack, and/or hole) that requires patching. Accordingly, a tool string 200 can be lowered from a rig 20 and into the wellbore 40. The tool string 200 can include a substantially tubular patch configured to repair or seal the defect 52 in the casing 50.

Figure 2:
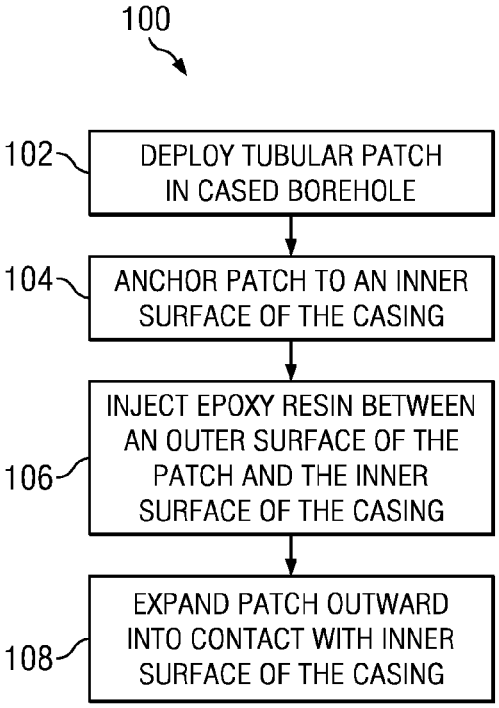
FIG. 2 depicts an illustrative method for patching the defect in the casing, according to one or more embodiments disclosed.

FIG. 2 depicts an illustrative method 100 for patching the defect 52 in the casing 50, according to one or more embodiments. The method 100 is described with reference to the tool string 200 depicted in FIGS. 1 and 3A-3C. A tubular patch 300 can be disposed on, in, and/or around the tool string 200 and positioned in the casing 50 proximate the defect 52, as shown at 102. The patch 300 can be anchored to an inner surface of the casing 50, for example, using an anchoring tool 240, as shown at 104.

Once anchored, the patch 300 can be expanded into contact with the inner surface of the casing 50. For example, an expansion tool 350 can be traversed or pulled in the uphole direction through the patch 300, as shown at 108. As used herein, the term "uphole" refers to a direction that is toward the surface and/or the rig 20, or a position that is closer to the surface and/or the rig 20 than another position. The term "downhole" refers to a direction that is away from the surface and/or the rig 20, or a position that is within the cased wellbore 40, i.e., below the Earth's surface.

In one or more embodiments, a sealant or adhesive material, such as an epoxy resin for example, can be used to provide a better seal or adherence between the patch 300 and the casing 50. The sealant or adhesive material can be applied to the patch 300 before the patch 300 is lowered into the wellbore 50. Alternatively, the sealant or adhesive material can be applied to the patch 300 after it has been located in the wellbore 50. For example, the sealant or adhesive material can be injected between an outer surface of the patch 300 and the inner surface of the casing 50 using an injection tool 270, as shown at 106. In the case of an epoxy resin, the epoxy resin can be mixed with a hardener downhole to form the adhesive mixture after the patch 300 is located in the casing 50. The epoxy resin and the hardener can be mixed together simultaneously with or subsequent to the patch 300 being anchored to the inner surface of the casing 50.

Figure 3:
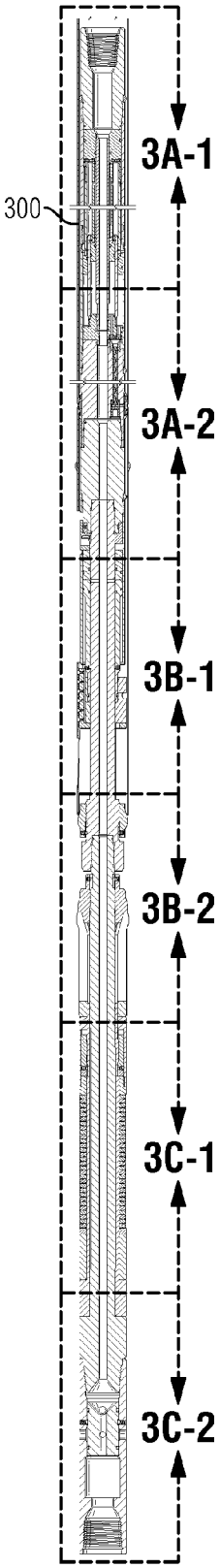
Figures 1, 3A:
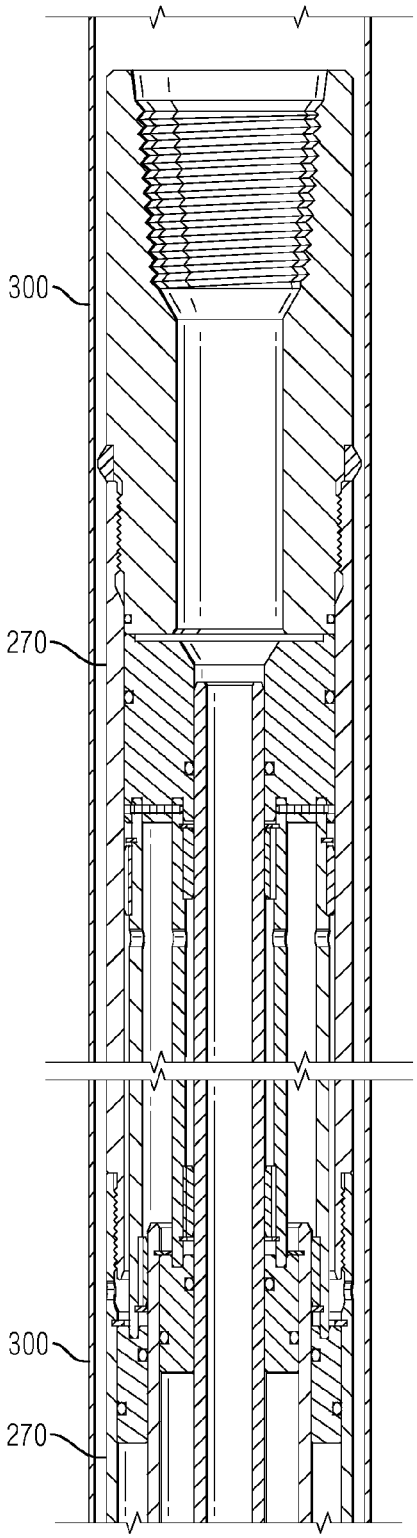
Figures 2, 3A:
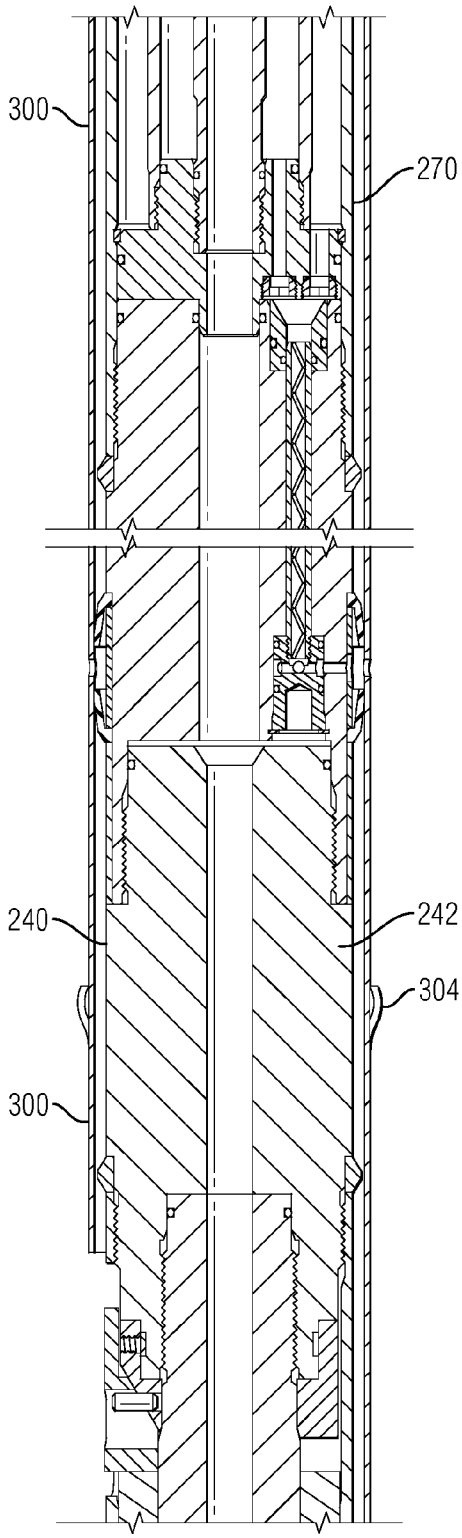
Figures 1, 3B:
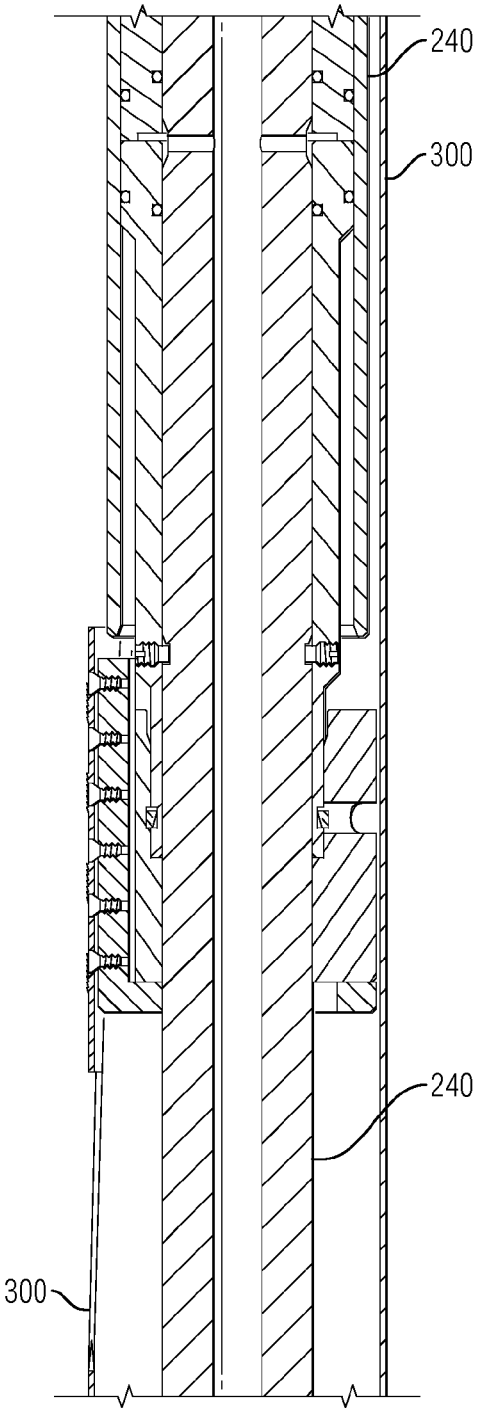
Figures 2, 3B:
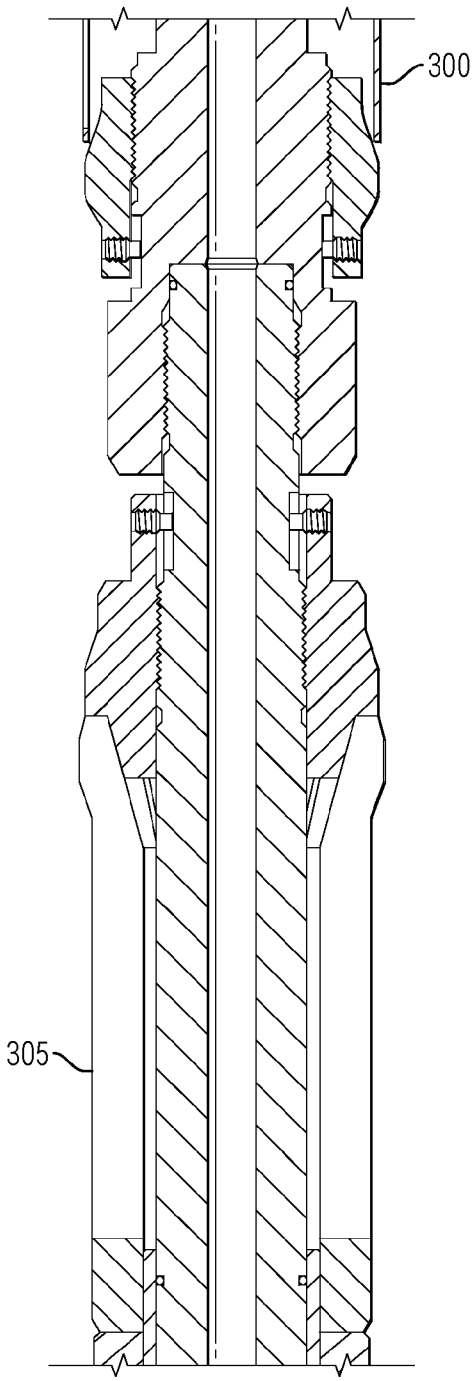
Figures 1, 3C:
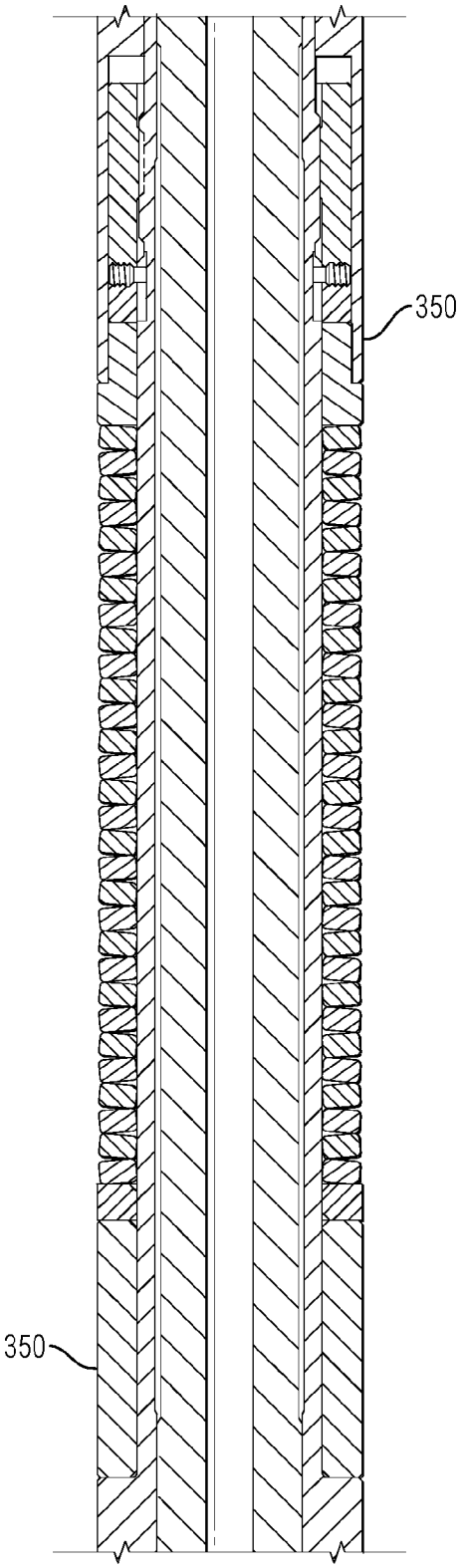
Figures 2, 3C:
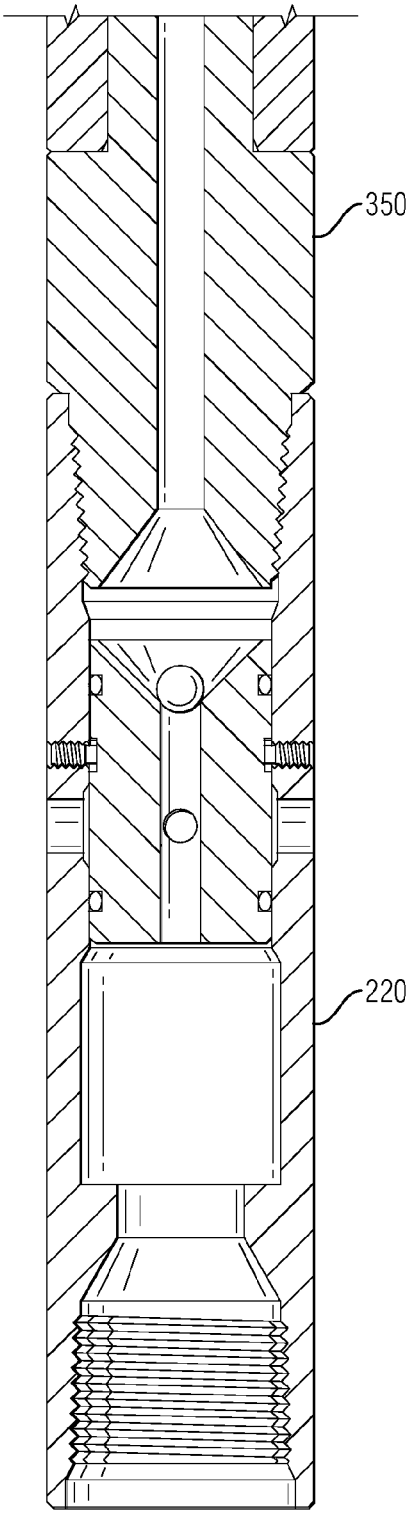

FIGS. 3 depicts a cross-sectional view of an illustrative tool string 200 (FIG. 1) and patch 300, according to one or more embodiments. Portions of the illustrative tool string and patch shown in FIG. 3 are also illustrated in the cross-sectional views of FIGS. 3A-1 to 3C-2. The tool string 200 can include a ball seat assembly 220, anchoring assembly 240, expansion assembly 350, and optionally an injection assembly 270. The expansion tool 350 can be disposed above and threadably coupled to the ball seat assembly 220. Then anchoring assembly 240 can be disposed above and threadably coupled to the expansion tool 350. If needed, the injection tool 270 can be disposed above and threadably coupled to the anchoring tool 240. As used herein, the terms "couple," "coupled," "connect," "connection," "connected," "in connection with," and "connecting" refer to "in direct connection with" or "in connection with via another element or member." The terms "up" and "down"; "upper" and "lower"; "upwardly" and "downwardly"; "upstream" and "downstream"; "above" and "below"; and other like terms as used herein refer to relative positions to one another and are not intended to denote a particular direction or spatial orientation.

Figure 4:
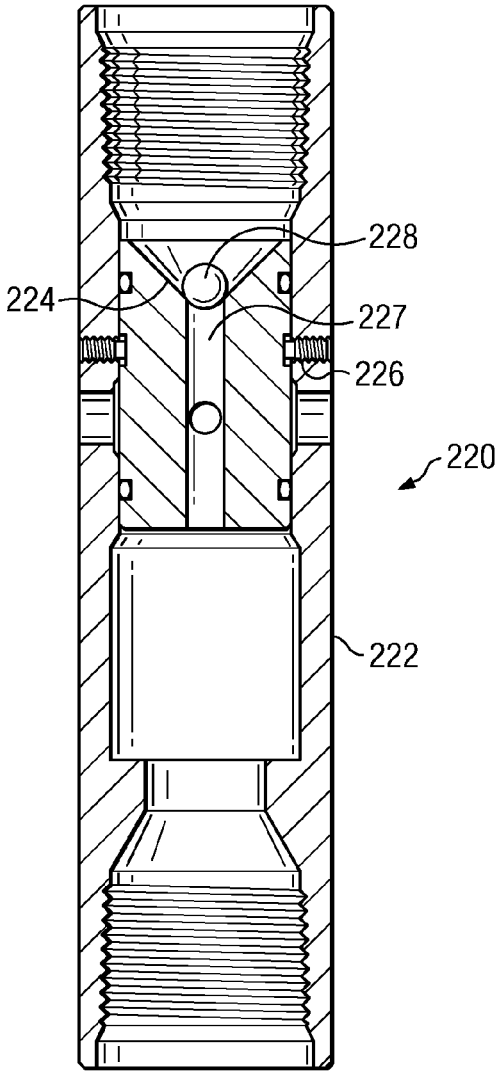
FIG. 4 depicts a cross-sectional view of an illustrative ball seat assembly or tool, according to one or more embodiments disclosed.

FIG. 4 depicts a cross-sectional view of an illustrative ball seat assembly or tool 220, according to one or more embodiments. The ball seat assembly 220 can include a housing or body 222 having threaded ends. A ball seat 224 can be disposed in the housing 222 and secured in place with one or more shear screws 226. In at least one embodiment, the ball seat 224 can be shaped and sized to accommodate a ball or other sealing mechanism 228. For example, the ball seat 224 can be curved or frustoconical and have an aperture 227 formed therethrough. The ball or sealing mechanism 228 can provide a seal against the aperture 227 to prevent fluid flow in at least one direction through the assembly 220. The ball or sealing mechanism 228 can be made of any suitable material. In one or more embodiment, the ball or sealing mechanism 228 can be a steel ball, a thermoplastic ball, a dart, or the like.

After the patch 300 has been positioned proximate the defect 52 in the casing 50 (e.g., step 102 in method 100), the ball 228 can be dropped from the surface and engage the ball seat 224 to prevent fluid flow in at least one direction therethrough. In deviated wellbores, gravitational force alone may not be sufficient to move the ball 228 from the surface and into engagement with ball seat 224. As such, in deviated wellbores, a liquid, such as a drilling fluid, can be introduced or injected into the wellbore 40 to force the ball 228 deeper into the wellbore 40 (e.g., along the horizontal section of the wellbore 40) and into contact with the ball seat 224.

Once the ball 228 is located within the seat 224, hydraulic pressure can build within the internal bore of the tool string 200. Once the internal hydraulic pressure reaches a predetermined level, the anchoring tool 240 and/or the injection tool 270 can actuate, as described in more detail below. Upon completion of the anchoring and injection steps (e.g., steps 104 and 106 in method 100), the hydraulic pressure in the internal bore of the tool string 200 can be increased until the shear screw 226 shears or breaks, allowing the ball seat 224 to drop and reestablishing fluid flow through ball seat assembly 220.

Figure 5A:
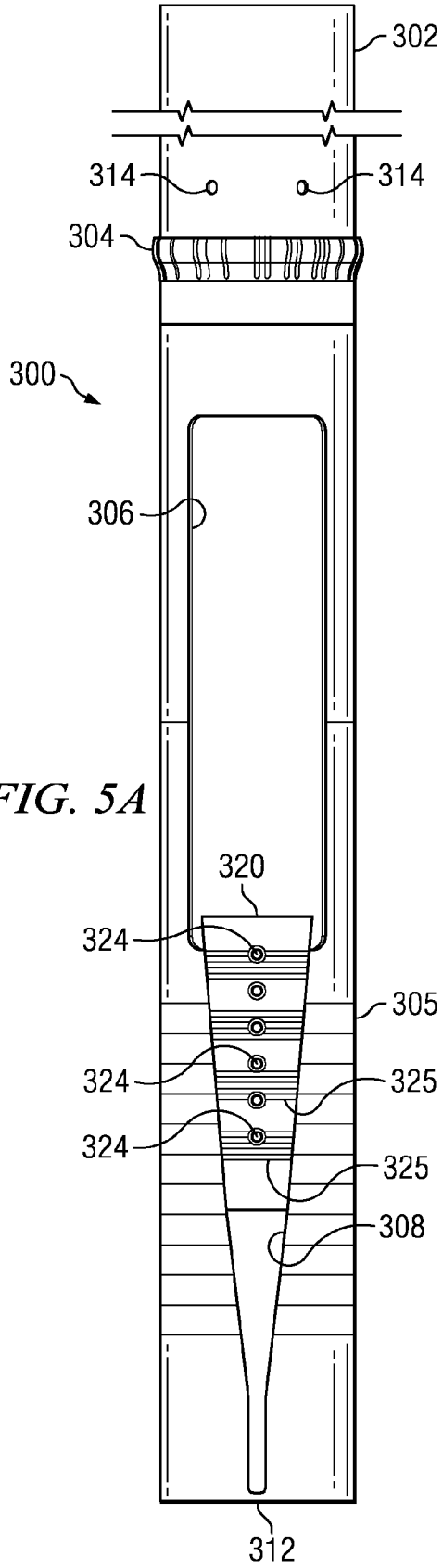
FIG. 5A depicts a cross-sectional view of a portion of an illustrative patch.

Considering the patch 300 in more detail, FIG. 5A depicts a cross-sectional view of a portion of the patch 300, according to one or more embodiments. The patch 300 can include a substantially tubular, thin-walled (i.e., hollow) body 302 disposed around a portion of the tool string 200. The patch 300 can be made from a metal. In at least one embodiment, the patch 300 can be made from steel or stainless steel. The patch 300 can have a length ranging from a low of about 1 m, about 2 m, or about 3 m to a high of about 6 m, about 8 m, about 10 m, or more. The patch 300 can have a cross-sectional length, e.g., diameter, ranging from a low of about 10 cm, about 15 cm, or about 20 cm to a high of about 30 cm, about 40 cm, about 50 cm, or more.

The patch 300 can have one or more expansion relief windows or openings (one is shown 306) formed therein. The opening 306 can reduce the stress on the patch body 302 when the patch 300 is expanded radially outward, e.g, during anchoring step 104. The opening 306 can be substantially rectangular having a width measured along the circumference of the patch body 302 and a length measured in the axial direction. A ratio of the width of the opening 306 to the diameter of the patch body 302 can range from a low of about 0.1:1, about 0.2:1, or about 0.4:1 to a high of about 0.6:1, about 0.8:1, about 1:1, or more. For example, the width of the opening 306 can range from a low of about 5 cm, about 10 cm, or about 15 cm to a high of about 20 cm, about 30 cm, about 40 cm, or more. A ratio of the length of the opening 306 to the diameter of the patch body 302 can range from a low of about 0.5:1, about 1:1, about 2:1, or about 3:1 to a high of about 4:1, about 6:1, about 8:1, about 10:1, or more. For example, the length of the opening 306 can range from a low of about 20 cm, about 40 cm, about 60 cm, about 80 cm, or about 1 m to a high of about 1.2 m, about 1.4 m, about 1.6 m, about 1.8 m, about 2 m, or more.

A tapered (V-shaped) slot 308 can be formed in the patch 300 proximate a lower end of the opening 306. As shown, the tapered slot 308 can be in communication with the opening 306. A width of the tapered slot 308, as measured along the circumference of the patch body 302, proximate the opening 306 can be greater than the width of the tapered slot 308 distal the opening 306. For example, the sides of the tapered slot 308 can be oriented at an angle with respect to a longitudinal center line through the patch body 302 ranging from a low of about 1°, about 2°, about 4°, about 6°, about 8°, or about 10° to a high of about 15°, about 20°, about 25°, about 30°, about 35°, about 40°, about 45°, or more. The tapered slot 308 can be adapted to receive a tapered wedge 320, as described in more detail below.

The patch body 302 can also include one or more protrusions or upsets 305 formed below the opening 306 and/or proximate the tapered slot 308. The upsets 305 can extend radially outward from the patch body 302 to increase the contact stress or force between the patch body 302 and the inner surface of the casing 50 (FIG. 1). For example, each upset 305 can extend radially outward beyond the outer surface of the patch body 302 by about 0.5 mm, about 1 mm, about 2 mm, about 3 mm, about 4 mm, about 5 mm, about 6 mm, about 8 mm, about 10 mm, or more. Each upset 305 can have a height or axial length ranging from about 1 mm, about 2 mm, about 5 mm, or about 1 cm to about 2 cm, about 4 cm, about 6 cm, about 8 cm, about 10 cm, or more. When two or more upsets 305 are used, the axial spacing between the upsets 305 can range from about 1 mm, about 2 mm, about 5 mm, or about 1 cm to about 2 cm, about 4 cm, about 6 cm, about 8 cm, about 10 cm, or more. By reducing the surface area in contact with the inner surface of the casing 50, the upsets 305 can increase the contact stress or force between the patch body 302 and the inner surface of the casing 50. Accordingly, the upsets 305 can improve the anchoring ability of the patch body 302 within the casing 50.

A ring or web 312 can be formed proximate the lower end of the tapered slot 308. The ring 312 can be a portion of the patch body 302 that extends, at least partially, around the circumference of the body 302. As such, the ring 312 can prevent the patch body 302 from prematurely expanding during deployment in the wellbore 40. The ring 312 can have a height or axial length ranging from a low of about 0.5 cm, about 1 cm, or about 2 cm to a high of about 4 cm, about 6 cm, about 8 cm, or more.

The patch body 302 can also include a plurality of ports 314 formed above the expansion opening 306 through which adhesive may be injected (e.g., during injection step 106—FIG. 2). Any number of ports 314 can be used. The ports 314 can be circumferentially and/or axially spaced apart around the patch body 302. In at least one embodiment, a resilient barrier cup 304, e.g., formed of a thin metallic material, can be at least partially disposed about the patch body 302 and below the injection ports 314. The barrier cup 304 can form a seal with an inner surface of the casing 50 to prevent injected adhesive from traveling in the downhole direction through the annulus towards the opening 306. Rather than a barrier cup 304, an extension (see 303 in FIG. 10B) can be formed in the patch body 302 below the injection ports 314.

Figure 5B:
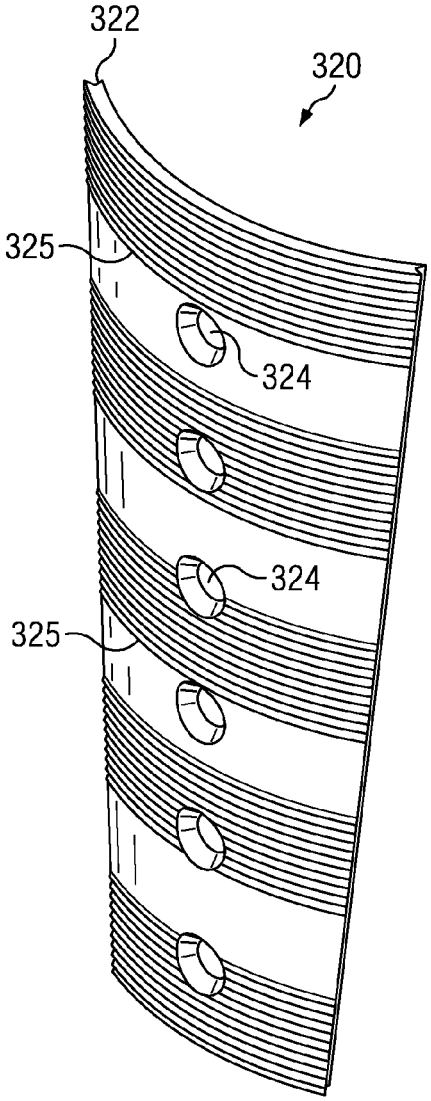
FIG. 5B depicts a perspective view of an illustrative tapered locking wedge, according to one or more embodiments disclosed.

FIG. 5B depicts a perspective view of an illustrative tapered locking wedge 320, according to one or more embodiments. The tapered wedge 320 can be located or disposed within the tapered slot 308 and adapted to help anchor the patch 300 against the casing 50, as described in more detail below. The tapered wedge 320 can be made from a metal, such as a hardened steel alloy and have a radius of curvature to match the patch body 302. As such, the tapered wedge 320 can be adapted to slide axially within the tapered slot 308. And as with the tapered slot 308, the width of the tapered wedge 320 can decrease in the downhole direction. For example, the sides of the tapered wedge 320 can be oriented at an angle with respect to a longitudinal center line through the patch body 302 ranging from a low of about 1°, about 2°, about 4°, about 6°, about 8°, or about 10° to a high of about 15°, about 20°, about 25°, about 30°, about 35°, about 40°, about 45°, or more. In at least one embodiment, the sides of the tapered wedge 320 can have a profile adapted to engage the sides of the tapered slot 308.

The axially-extending sides of the tapered slot 308 and the axially-extending sides of the tapered wedge 320 can each have a helical profile. In other words, when the tapered wedge 320 is engaged with the tapered slot 308, the upper or uphole end of the tapered slot 308 can be disposed radially outward from the lower or downhole end of the tapered slot 308 with respect to a longitudinal center line through the body 302. Similarly, the upper or uphole end of the tapered wedge 320 can be disposed radially outward from the lower or downhole end of the tapered wedge 320 with respect to the longitudinal center line through the body 302. Accordingly, the helical profile of the tapered slot 308 and the tapered wedge 320 can cause the force between axially extending sides of the tapered slot 308 and the tapered wedge 320 to be circumferential.

The axially-extending sides of the tapered wedge 320 can also include a groove 322 adapted to receive a protrusion formed in the sides of the tapered slot 308, or vice versa. However, as may be appreciated, the axially-extending sides of the tapered slot 308 and tapered wedge 320 can be formed in any manner to form a track to prevent the tapered wedge 320 from becoming disengaged with the tapered slot 308 as the tapered wedge 320 slides therein.

The tapered wedge 320 can further include a plurality of holes 324 through which the wedge 320 can be coupled to the anchoring tool 240. For example, one or more shear screws 253 (shown in FIG. 6B) can be disposed through the holes 324 to couple the tapered wedge 320 to the anchoring tool 240, as described in more detail below.

The tapered wedge 320 can also include a plurality of wickers or teeth 325 formed in the outer surface thereof. The wickers 325 can be adapted to engage (bite) the inner surface of the casing 50 to prevent axial motion of tapered wedge 320 in the uphole direction (e.g., during expansion step 108 in FIG. 2). The wickers 325 can extend radially outward from the tapered wedge 320 by about 0.1 mm, about 0.2 mm, about 0.5 mm, or about 1 mm to about 2 mm, about 3 mm, about 4 mm, about 5 mm, or more.

When the patch 300 is disposed adjacent the defect 52 in the casing 50, the anchoring tool 240 can move the tapered wedge 320 downward in the tapered slot 308. As the tapered wedge 320 moves downward, the portion of the patch 300, i.e., patch body 302, proximate the tapered slot 308 can expand radially outward and contact the casing 50. For example, the upsets 305 can contact the casing 50. The contact between the patch 300 and the casing 50 can anchor the patch 300 in place, thereby substantially preventing axial movement of the patch 300 with respect to the casing 50. Any slippage of the patch 300 in the uphole direction can drive the tapered wedge 320 deeper into the tapered slot 308, thereby increasing the tangential force that secures the patch 300 in the casing 50. Once a predetermined downward force has been applied to the tapered wedge 320 (anchoring the patch 300 in the casing 50), the shear screws 253 can shear or break, releasing or decoupling the patch 300 and the tapered wedge 320 from the anchoring tool 240. The tool string 200 (including the expansion tool 350) can then be pulled upward toward the surface. As the expansion tool 350 moves upward through the patch 300, it can expand the patch 300 radially outward and into contact with the casing 50, as described in more detail below.

Figure 6A:
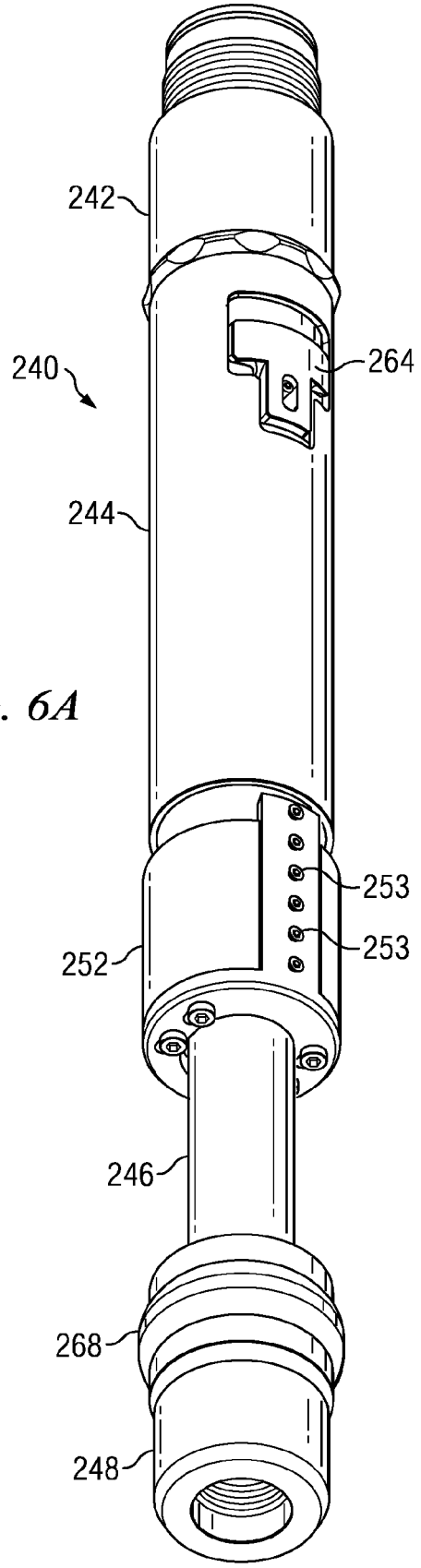
FIGS. 6A and 6B depict a perspective view and a cross-sectional view, respectively, of an illustrative anchor tool, according to one or more embodiments disclosed.
Figure 6B:
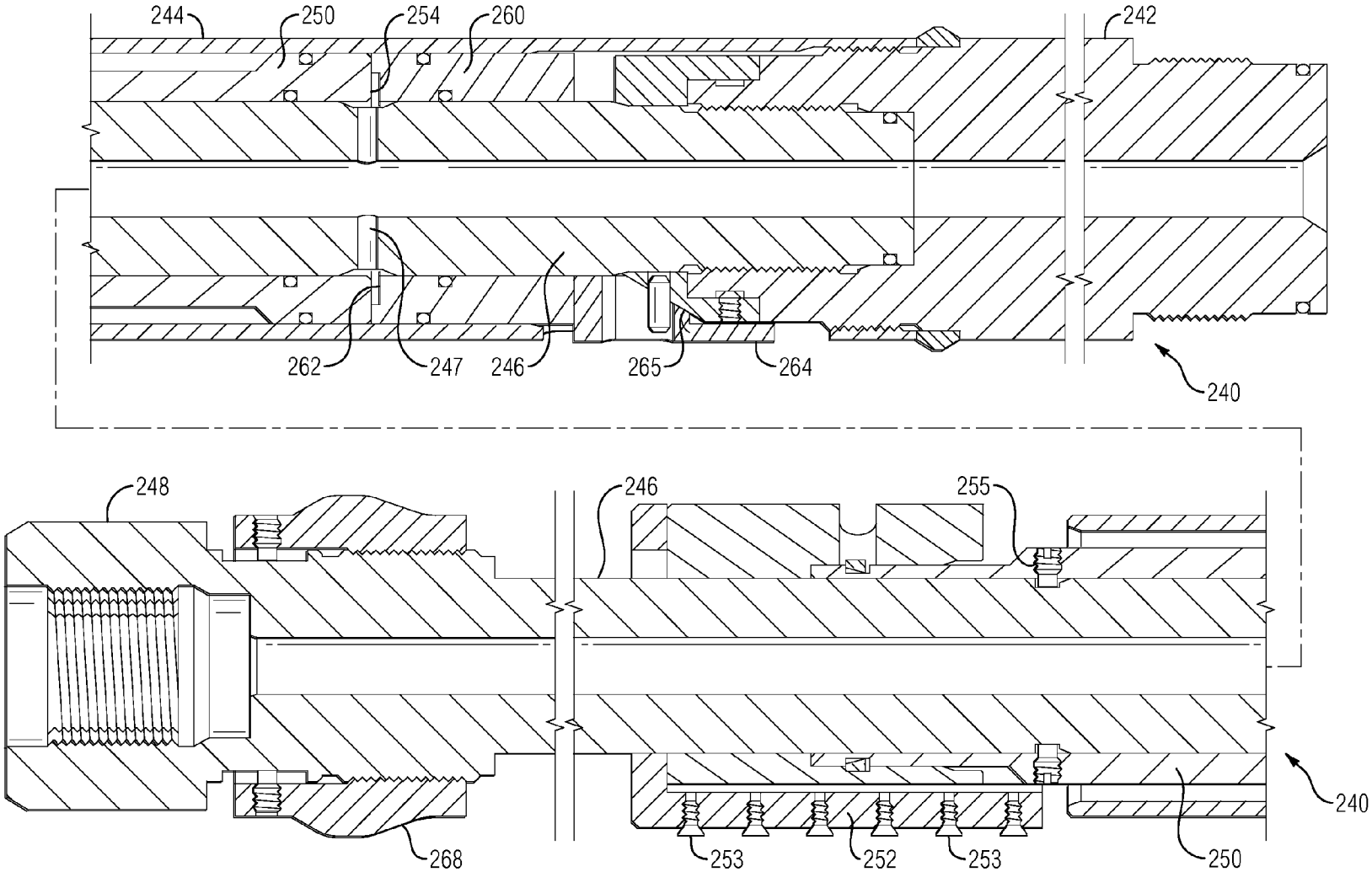

FIG. 6A depicts a perspective view of an illustrative anchoring tool 240, and FIG. 6B depicts a cross-sectional view of the anchoring tool 240, according to one or more embodiments. The anchoring tool 240 can be sized and shaped to be disposed in the interior of patch 300, as depicted in FIG. 3. A first "main" piston 250 and a second "locking" piston 260 can be disposed around a piston rod 246. An upper end portion of the piston rod 246 can be threadably engaged with an upper mandrel 242, which can be coupled to the injection tool 270. A lower end portion 248 of the piston rod 246 can be coupled to the expansion tool 350. The main piston 250 can also be coupled to a wedge carrier 252. The wedge carrier 252 can be coupled to the tapered wedge 320 (see FIG. 5B) via one or more shear screws 253.

Hydraulic pressure can be communicated to surfaces 254, 262 of the corresponding main and locking pistons 250, 260 through one or more radial bores 247 formed in the piston rod 246. Prior to hydraulic activation, an outer surface of a dog 264 can be substantially flush with an outer surface of a cylindrical sleeve 244. As the pressure increases, the locking piston 260 can be urged upward, thereby moving the dog 264 up a ramp 265. Movement of the dog 264 up the ramp 265 can cause the dog 264 to engage the patch body 302 in the opening 306. Such engagement can prevent subsequent axial movement of the patch body 302 in the downhole direction when the tapered wedge 320 is driven into the tapered slot 308. Increasing hydraulic pressure can also urge the main piston 250 against a shear screw 255. At a predetermined hydraulic pressure, the screw 255 can break or shear, thereby allowing downhole movement of the main piston 250 and the wedge carrier 252 relative to the piston rod 246. Such movement of the main piston 250 can urge the tapered wedge 320 into the tapered slot 308. The wedge carrier 252 can move in a radial direction as the main piston 250 urges the tapered wedge 320 into the tapered slot 308. Radial movement of the tapered wedge 320 can allow it to follow the expansion of patch body 302 caused by the wedging action.

The anchoring tool 240 can further include a fixed cone 268 coupled to the piston rod 246. The cone 268 can be sized and shaped to provide a preliminary expansion (e.g., about 50% of the total expansion) of the patch body 302 as the tool string 200 is drawn uphole during expansion step 108. Such a preliminary expansion can reduce the force requirements of expansion tool 350 during the subsequent expansion.

In at least one embodiment, the anchoring tool 240 can be spring actuated. U.S. Pat. No. 7,428,928 discloses a spring actuated anchoring tool. This application is incorporated herein by reference in its entirety to the extent consistent with the present disclosure.

Figure 7:
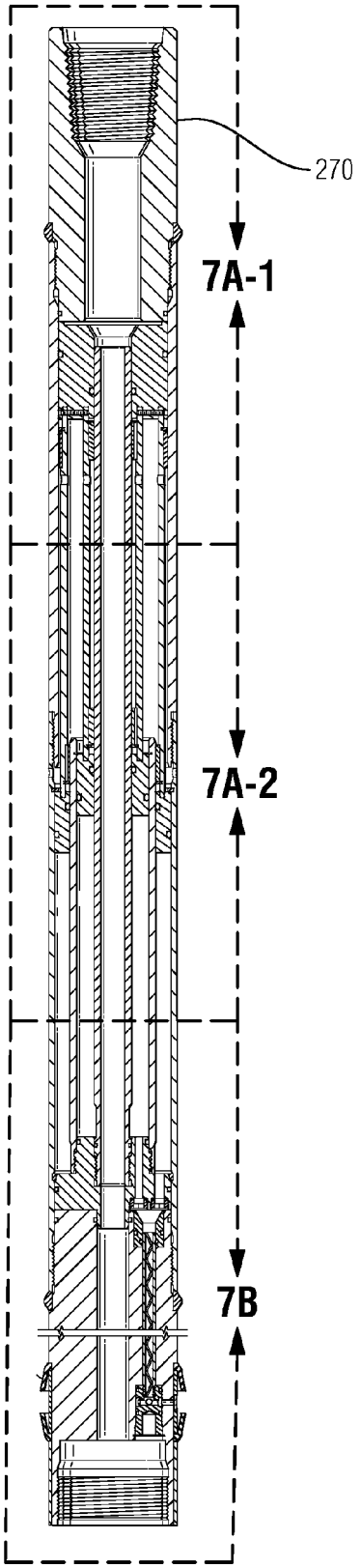
Figures 1, 7A:
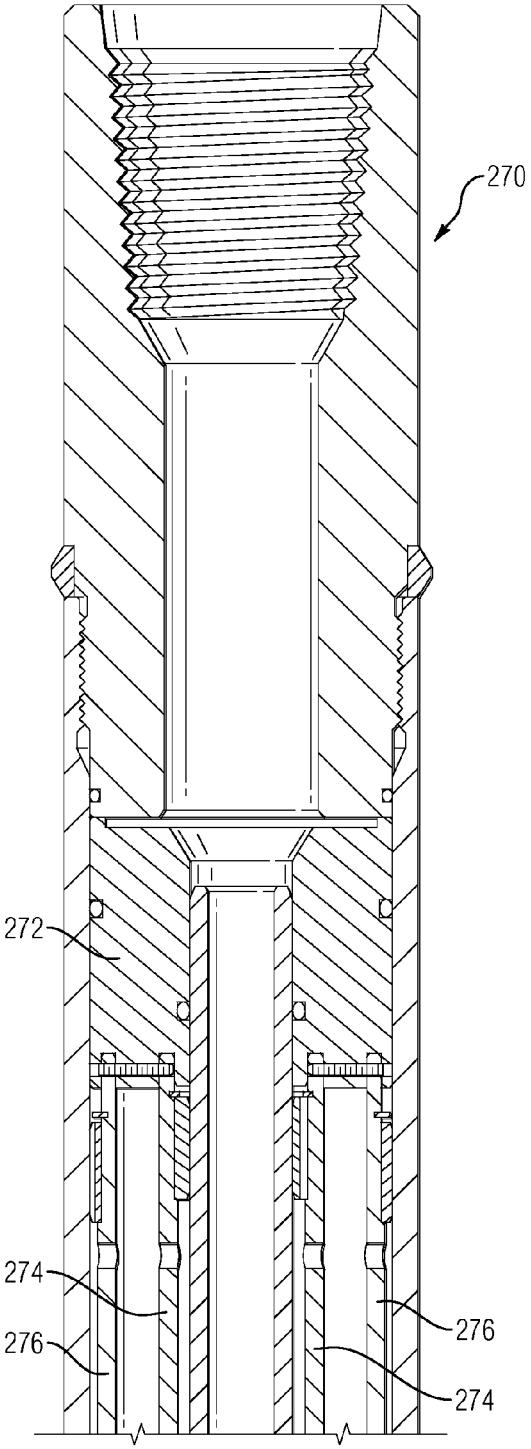
Figures 2, 7A:
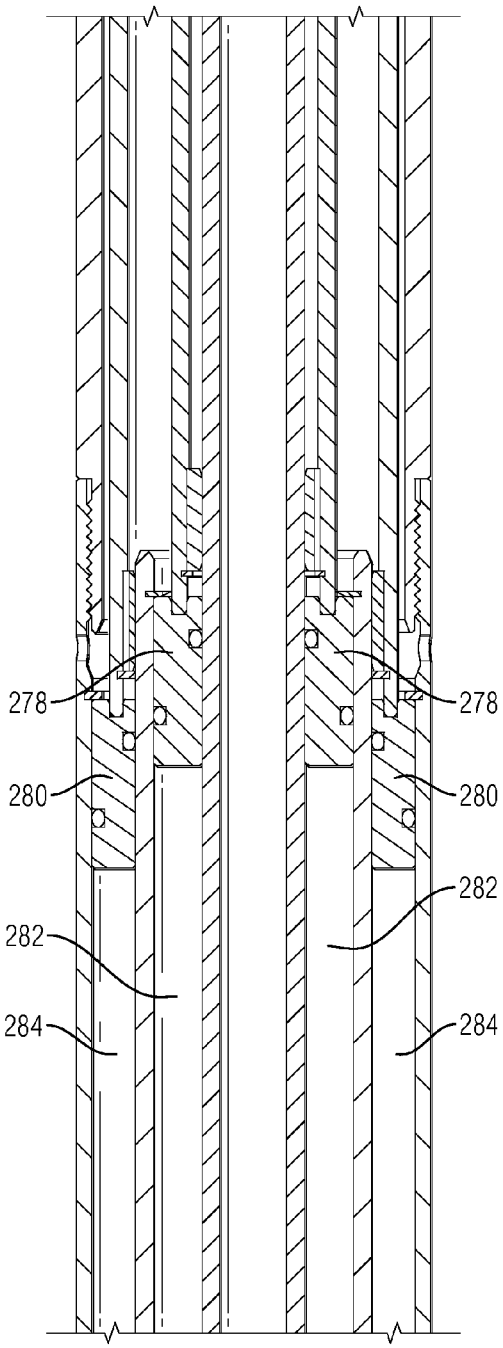
Figure 7B:
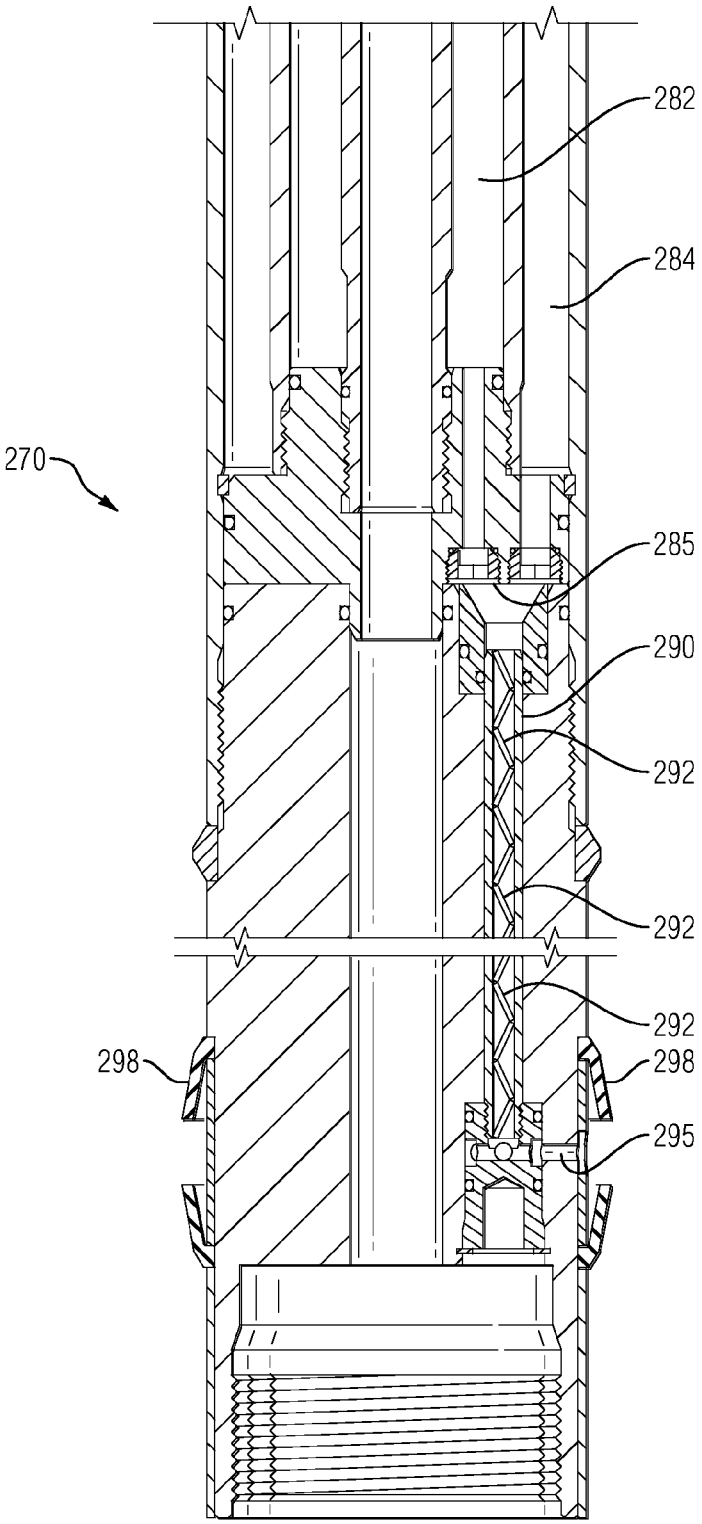

FIG. 7 depicts a cross-sectional view of an illustrative injection tool 270, according to one or more embodiments. Portions of the illustrative injection tool 270 are also illustrated in the cross-sectional views of FIGS. 7A-1, 7A-2, and 7B. As shown, the injection tool 270 can include plurality of moving pistons or tubes. For example, the injection tool 270 can include a main piston 272, inner push tube 274, and outer push tube 276. Increasing hydraulic pressure can urge the main piston 272 in the downhole direction and into contact with the inner push tube 274 and the outer push tube 276. The inner push tube 274 can engage an epoxy resin piston 278, and the outer push tube 276 can engage a hardener piston 280, or vice versa. As such, the push tubes 274, 276 can increase the pressure of the epoxy resin and hardener disposed in corresponding chambers 282, 284.

At a substantially predetermined hydraulic pressure, one or more burst discs 285 can rupture allowing the epoxy resin and hardener to flow into a static mixing chamber 290. The static mixing chamber 290 can include a number of tortuous elements 292 that alter the direction of fluid flow which causes the epoxy resin and hardener to intermingle and form an adhesive mixture. The adhesive mixture can exit the mixing chamber 290 through ports 295 (and ports 314 of patch body 302 of FIG. 5A) into the annular region between the patch body 302 and the casing 50. A barrier cup 298 can, at least partially, prevent migration of the mixture between the injection tool 270 and the patch body 302. As described above, a barrier cup 304 (or extension 303) can also be disposed around the patch body 302 (as depicted in FIG. 5A) to substantially prevent the adhesive mixture from migrating in the downhole direction toward the opening 306. The injection tool 270 can use substantially any suitable formulation of epoxy resin/hardener. For example, the epoxy resin and hardener can be mixed in a two-to-one volume ratio.

Figure 8:
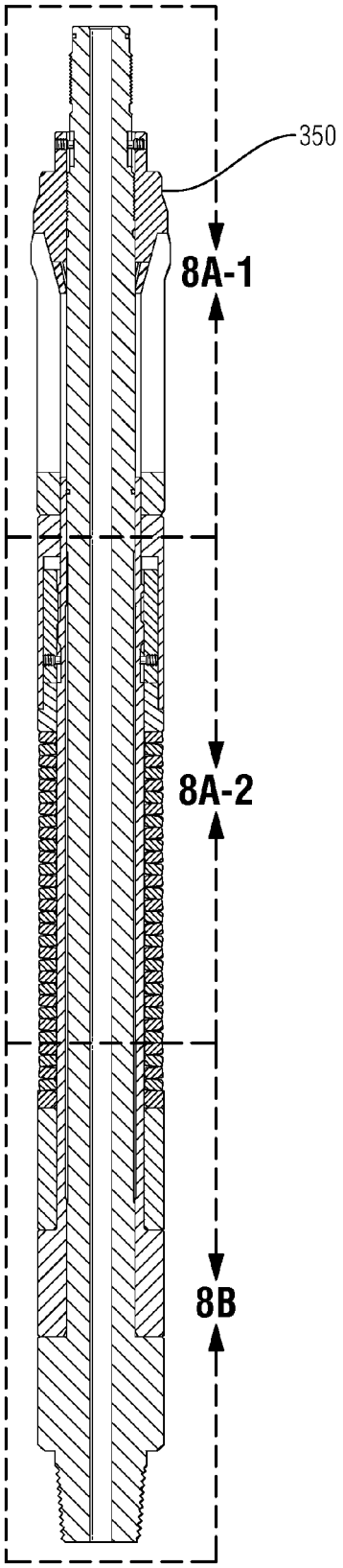
Figures 1, 8A:
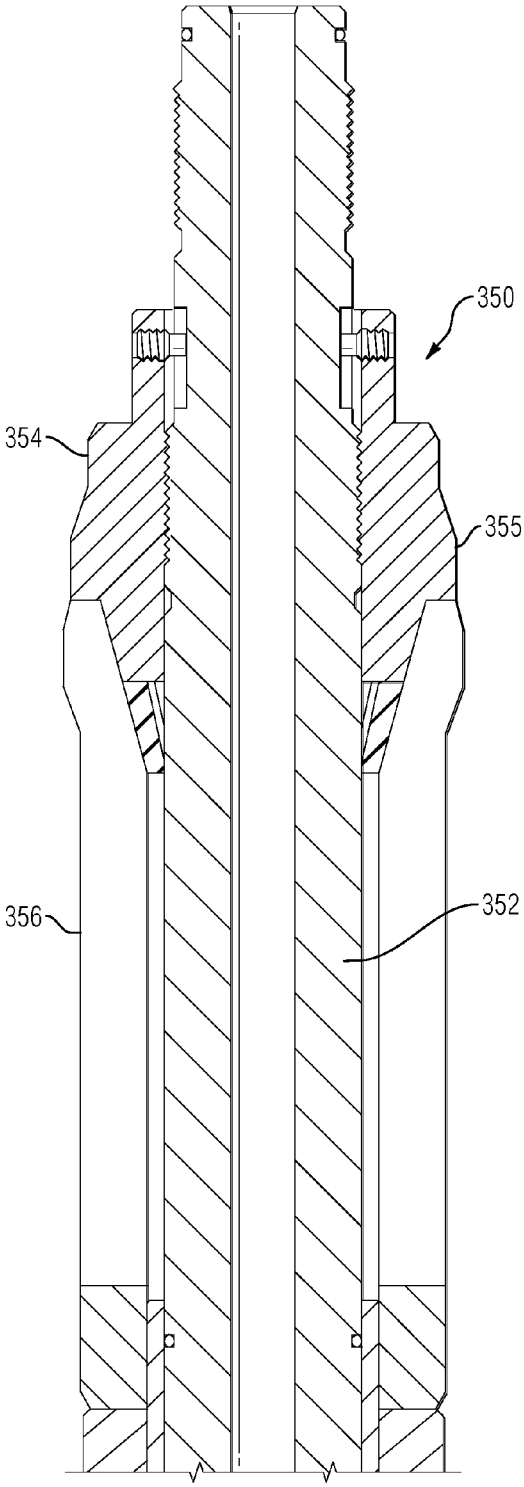
Figures 2, 8A:
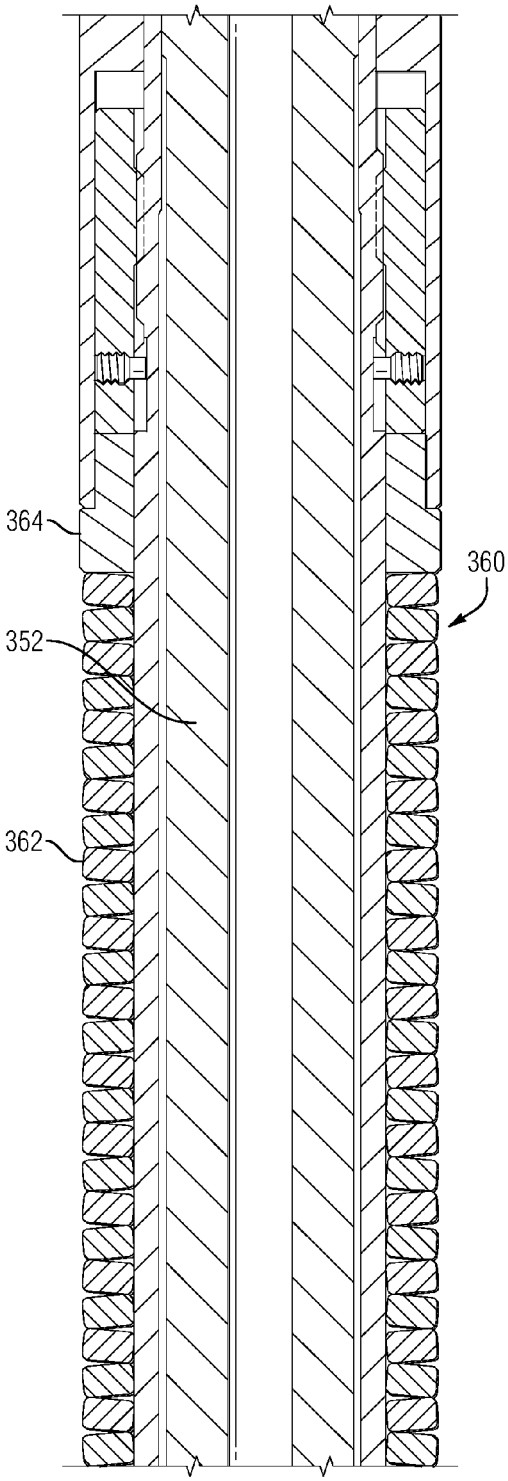
Figure 8B:
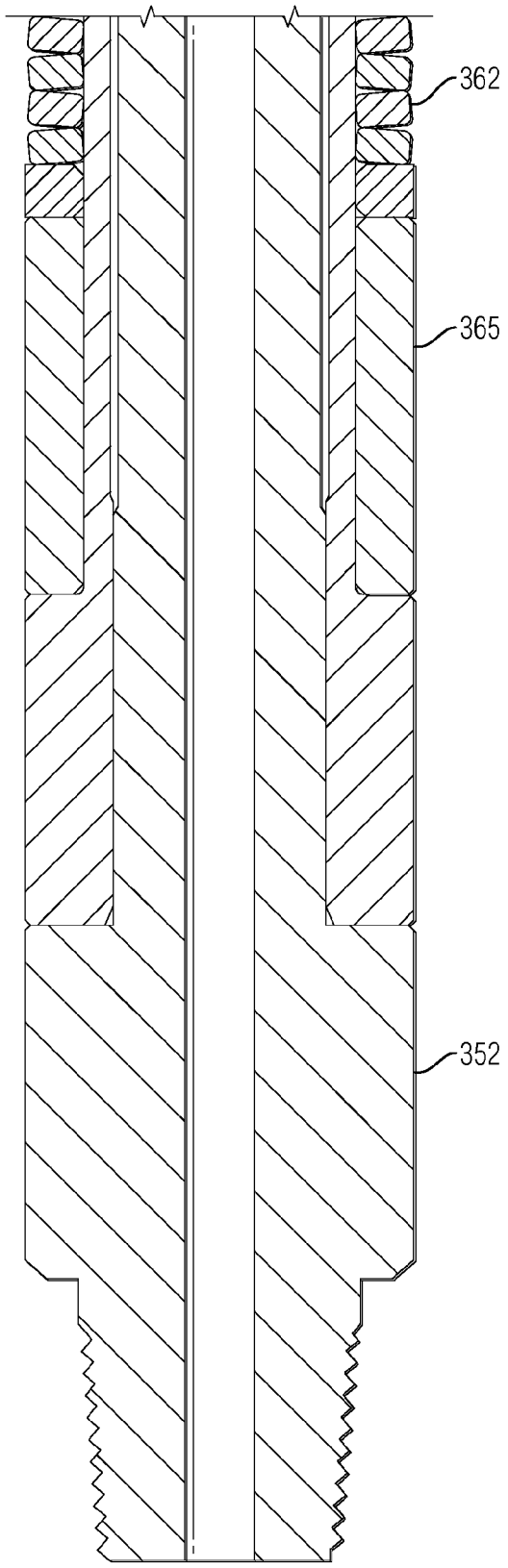

FIG. 8 depicts a cross-sectional view of an illustrative expansion tool 350, according to one or more embodiments. Portions of the illustrative expansion tool 350 are also illustrated in the cross-sectional views of FIGS. 8A-1, 8A-2, and 8B. The expansion tool 350 can include a mandrel 352 disposed within a collet cone 354, a collet 356, and a spring subassembly 360. The spring subassembly 360 can include a Belleville spring stack 362 disposed between upper and lower washers 364 and 365. The spring stack 362 can be biased (i.e., compressed) to provide a predetermined axial force urging the collet 356 in the uphole direction. The collet 356 can include a plurality of circumferentially spaced fingers that ride up on the collet cone 354 into contact with a shoulder 355 of the cone 354.

During the expansion step 108 (FIG. 2), both the shoulder 355 of the collet cone 354 and the collet 356 can provide additional expansion of the patch body 302. The collet cone 354 and collet 356 can be sized and shaped so as to mechanically expand the patch 300 radially outward and into contact (or near contact) with the inner surface of the casing 50 as the tool string 200 is drawn uphole. Maximum expansion can be provided when the collet 356 is urged in the uphole direction into contact with the shoulder 355. The spring stack 362 can provide a compliant mechanism that allows the collet 356 to move axially downhole (at a predetermined force) and the fingers to move radially inward should the expansion tool 350 encounter irregularities in the installed casing 50 (e.g., debris or a casing collar). Such axial and radial motion is intended to minimize the likelihood of the tool 350 becoming stuck in the casing 50 during the expansion step.

Figure 9:
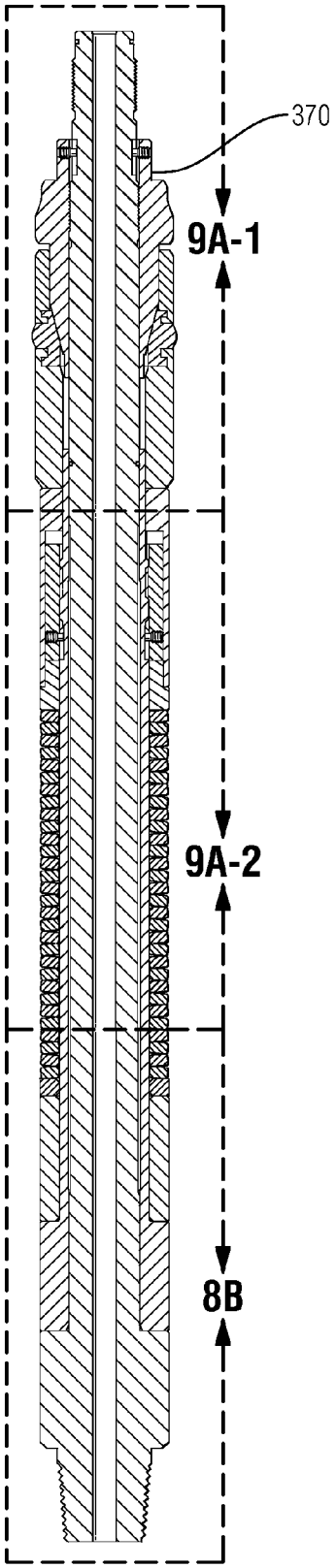
Figures 1, 9A:
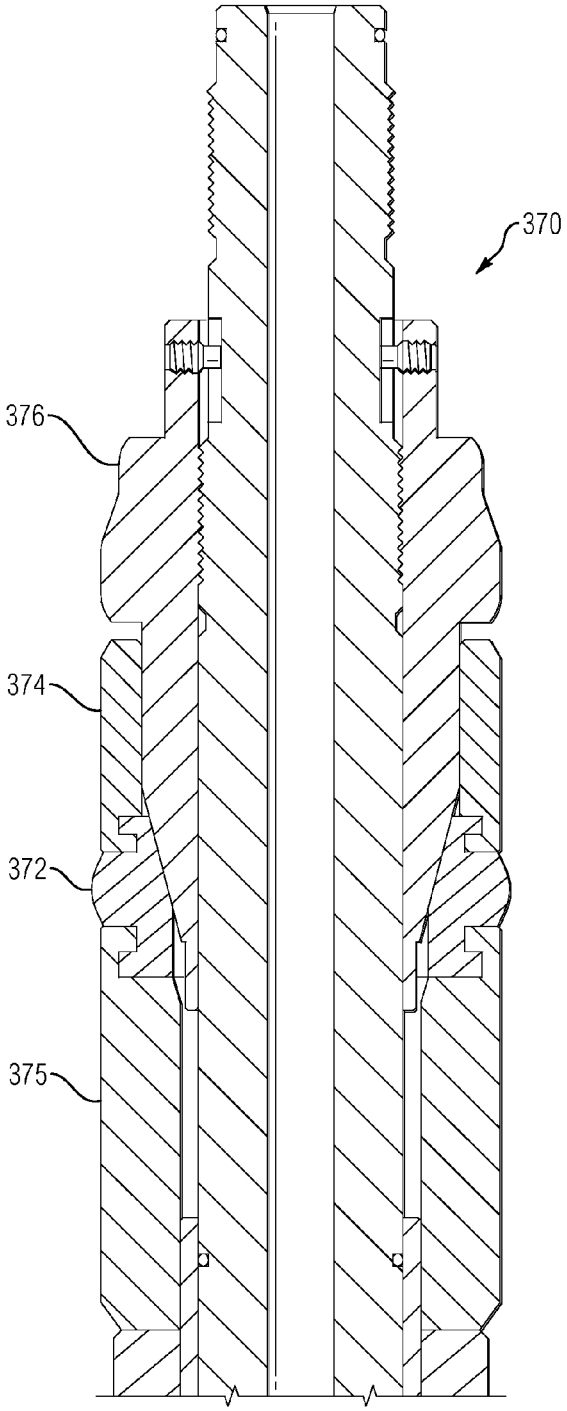
Figures 2, 9A:
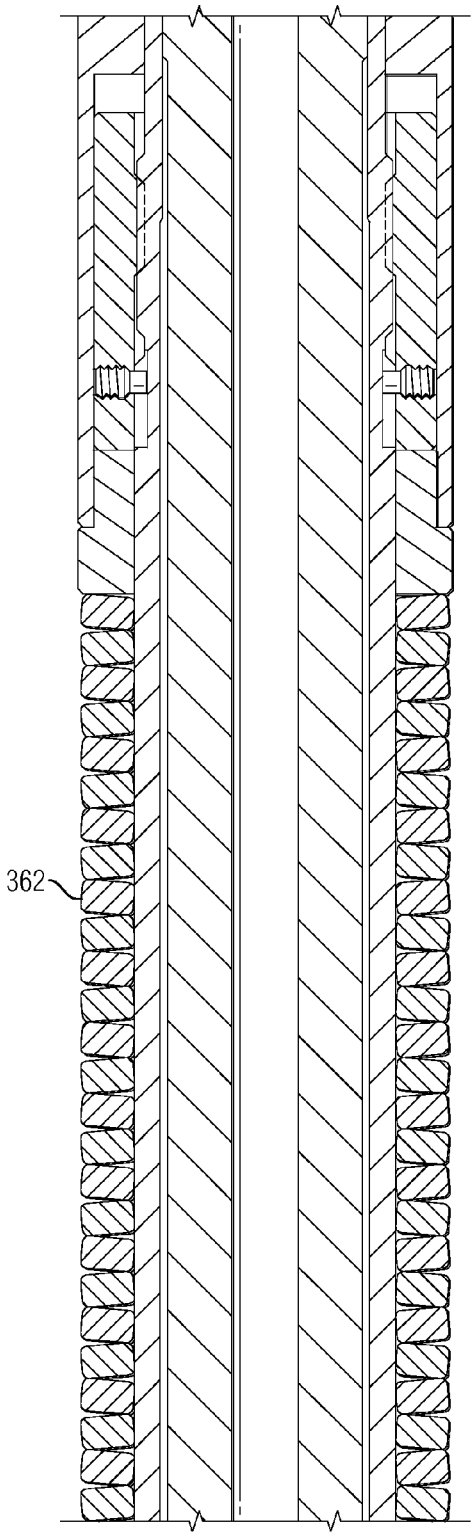

FIG. 9 depicts a cross-sectional view of another illustrative expansion tool 370, according to one or more embodiments. Portions of the illustrative expansion tool 370 are also illustrated in the cross-sectional views of FIGS. 9A-1, 9A-2, and 8B. The expansion tool 370 can include a plurality of circumferentially spaced flex segments 372 disposed between an upper retainer 374 and a lower retainer 375 and around a flex segment cone 376. The spring stack 362 can be biased to provide an axial force that urges the flex segments 372 in the uphole direction such that they ride up on the cone 376 and expand the patch body 302 as the tool string 200 is drawn uphole. The spring stack 362 can also provide a compliant mechanism that allows the flex segments 372 to move axially downhole and radially inward should the expansion tool 370 encounter irregularities in the installed casing 50. The flex segments 372 and flex segment cone 376 can be sized and shaped so as to mechanically expand the patch 300 into contact (or near contact) with the inner surface of the casing 50.

Figure 10A:
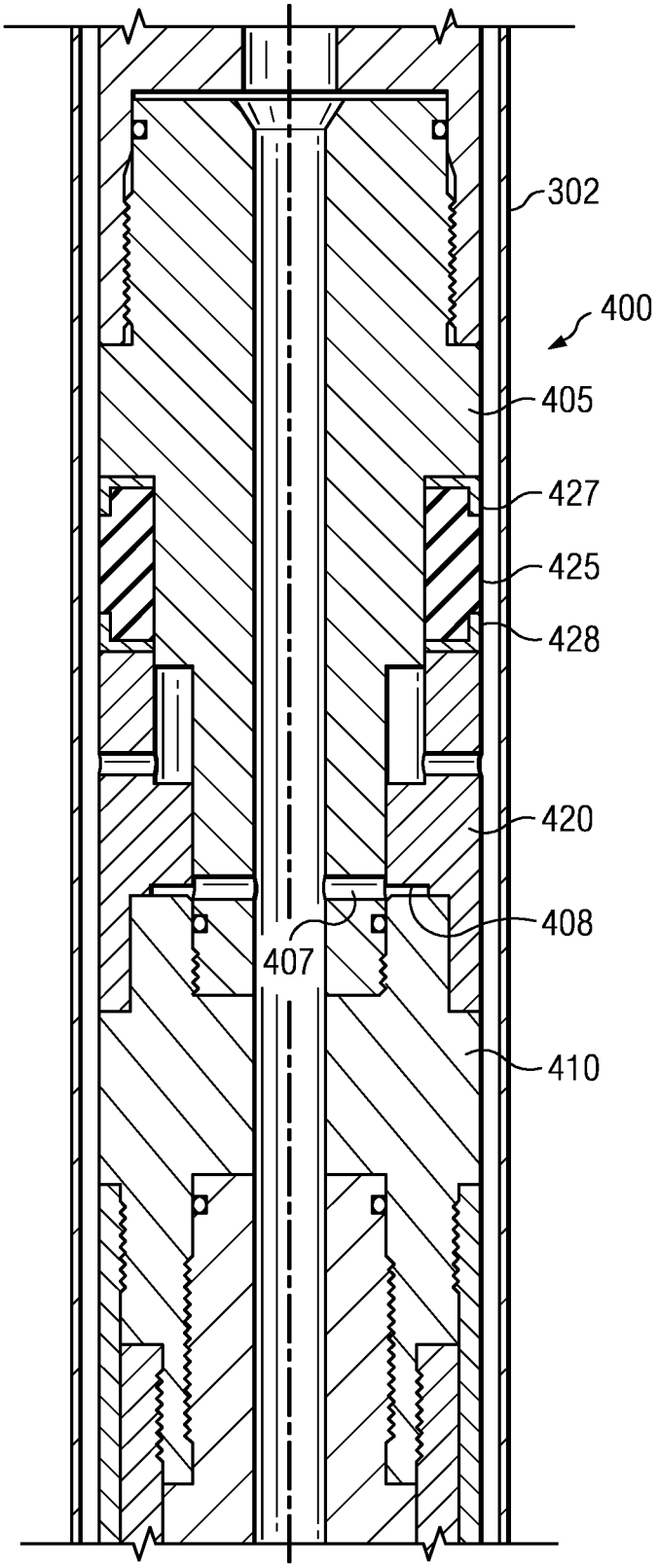
FIGS. 10A and 10B depict cross-sectional views of an illustrative bulger assembly, before and after actuation, according to one or more embodiments disclosed.
Figure 10B:
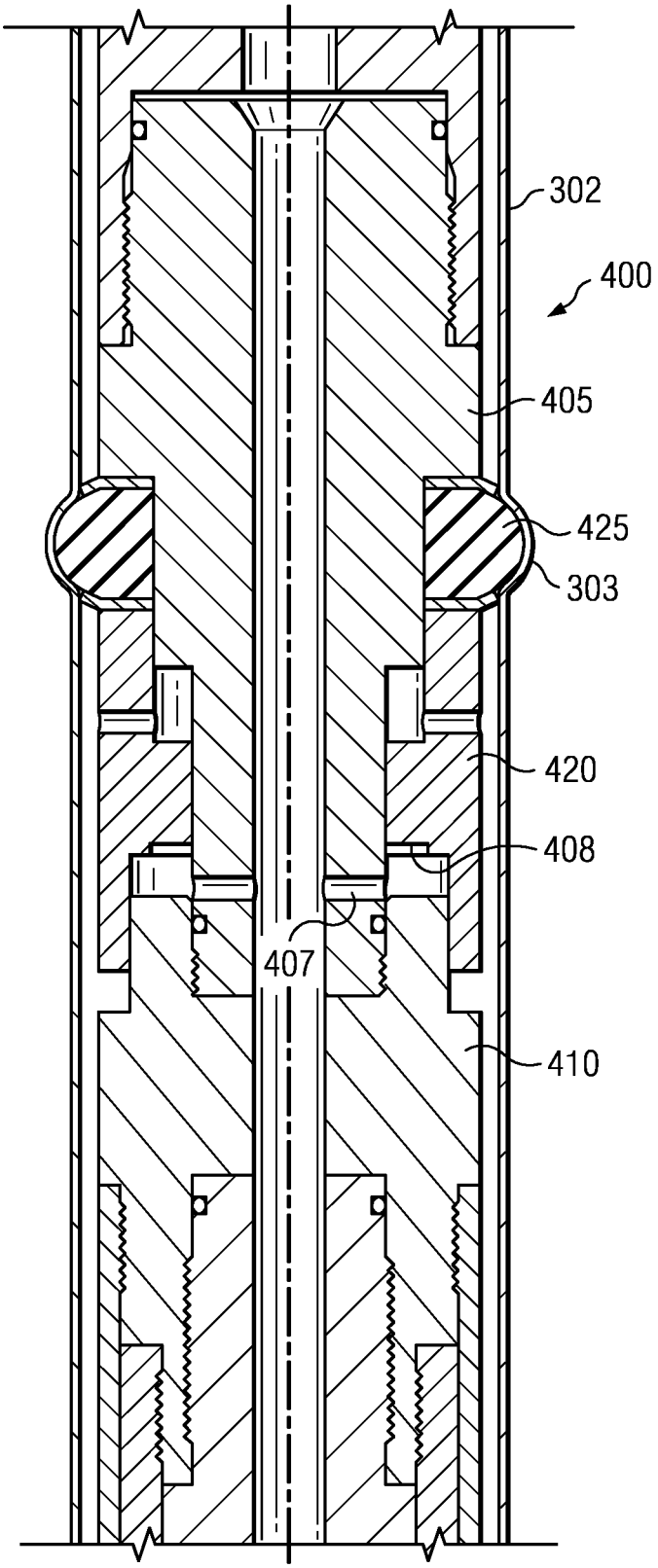

FIGS. 10A and 10B depict cross-sectional views of an illustrative bulger assembly 400 before and after actuation, according to one or more embodiments. The bulger assembly 400 can replace the upper mandrel 242 in the anchoring tool 240 (see FIG. 6B) and form or create a seal between the patch body 302 and the inner surface of the casing 50. The bulger assembly 400 can include uphole and downhole body portions 405, 410. An axial piston 420 can be disposed between the body portions 405, 410 and engage a bulger element 425. The bulger element 425 can be fabricated from a resilient material, such as a nitrile rubber, suitable for use in the downhole environment. First and second extrusion rings 427, 428 can be disposed about the bulger element 425. The extrusion rings 427, 428 can have an L-shaped cross-section and be fabricated from a low yield, highly ductile material such as brass. The bulger assembly 400 can be disposed at substantially any suitable location axially between injection port 314 and opening 306 of the patch 300.

During operation, hydraulic pressure can be communicated to the surface 408 of axial piston 420 through one or more radial bores 407 formed in body portion 405. As the pressure increases, the axial piston 420 can be urged uphole, thereby compressing the element 425 between the extrusion rings 427, 428. The element 425 can buckle radially outward into contact with the patch body 302, thereby deforming the patch body 302 radially outward into the inner surface of the casing, forming an extension 303, as best illustrated in FIG. 10B. The extrusion rings 427, 428 can also deform outward into contact with the patch body 302 and substantially prevent axial extrusion of the element 425 into the annular region on the inside of the patch body 302. The diameter of the patch body 302 in the extension region can be increased by about 1 cm, about 2 cm, about 3 cm, about 4 cm, about 5 cm, or more. Further, the extension 303 can have a height or axial length ranging from a low of about 1 cm, about 2 cm, about 3 cm, about 4 cm, about 5 cm, or more. The extension 303 can sealingly engage the inner surface of the casing 50 to substantially prevent injected epoxy from migrating in the downhole direction through the annulus towards expansion opening 306.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition those in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the invention can be devised without departing from the basic scope thereof. Accordingly, such other and further embodiments are intended to be included in the scope of this disclosure.

What is claimed is:

1. A patch for repairing a casing in a wellbore, comprising:

a hollow, substantially tubular body having one or more holes formed therethrough and adapted to have an adhesive flow therethrough;

an opening formed in the body below the one or more holes; and a tapered slot formed in the body below the opening, wherein a width of the tapered slot proximate the opening is greater than the width of the tapered slot distal the opening, and wherein the tapered slot is adapted to receive a tapered wedge and to expand radially outward as the tapered wedge slides within the tapered slot and away from the opening.

2. The patch of claim 1, wherein the tapered slot comprises axially-extending sides that are oriented at an angle with respect to a longitudinal center line through the body between about 1° and about 45°.

3. The patch of claim 2, wherein the axially-extending sides of the tapered slot are oriented helically along the longitudinal center line through the body.

4. The patch of claim 1, wherein the tapered slot receives the tapered wedge, and wherein the tapered wedge comprises axially-extending sides that are oriented at an angle with respect to a longitudinal center line through the body between about 1° and about 45°.

5. The patch of claim 4, wherein the axially-extending sides of the tapered wedge are oriented helically along the longitudinal center line through the body.

6. The patch of claim 1, wherein the tapered slot and the tapered wedge each comprise axially-extending sides, wherein the axially-extending sides of the tapered slot engage the axially-extending sides of the tapered wedge, and wherein profiles of the axially-extending sides of the tapered slot and the axially-extending sides of the tapered wedge are oriented helically along a longitudinal center line through the body.

7. The patch of claim 1, wherein in an unexpanded state, a ratio of a width of the opening to a diameter of the body is between about 0.2:1 and about 1:1, and a ratio of an axial length of the opening to the diameter of the body is between about 1:1 and about 8:1.

8. The patch of claim 7, wherein the axial length of the opening is at least three times the width of the opening.

9. The patch of claim 1, wherein the body further comprises a circumferential barrier disposed between the one or more holes and the opening, wherein the circumferential barrier extends radially outward from the body and is adapted to form a seal between the body and an inner surface of a casing.

10. A system for repairing a casing in a wellbore, comprising:

a patch, comprising:

a hollow, substantially tubular body;

an opening formed in the body; and a tapered slot formed in the body below the opening, wherein a width of the tapered slot proximate the opening is greater than the width of the tapered slot distal the opening;

an anchoring tool at least partially disposed within the patch, wherein the anchoring tool is adapted to move a tapered wedge within the tapered slot to expand at least a portion of the patch radially outward and into contact with an inner surface of the casing to anchor the patch in place with respect to the casing; and an expansion tool coupled to the anchoring tool, wherein the expansion tool is adapted to expand at least a portion of the patch radially outward and into contact with the inner surface of the casing when the expansion tool is pulled through the patch.

11. The system of claim 10, further comprising one or more shear screws coupling the anchoring tool to the tapered wedge, wherein the one or more shear screws are adapted to break when exposed to a predetermined force.

12. The system of claim 10, further comprising an injection tool coupled to the anchoring tool and at least partially disposed within the patch, wherein the injection tool is adapted to introduce an adhesive into an annulus formed between an outer surface of the patch and the inner surface of the casing.

13. The system of claim 12, wherein the adhesive comprises an epoxy resin and a hardener.

14. The system of claim 13, wherein the epoxy resin and the hardener are mixed together downhole.

15. The system of claim 10, the tubular body including a circumferential barrier above the opening and tapered slot formed in the body, the circumferential barrier extending radially outward from the tubular body and adapted to form a seal between the tubular body and the inner surface of the casing.

16. A method for repairing a casing in a wellbore, comprising:

running a patch into the wellbore, wherein the patch comprises:

a hollow, substantially tubular body;

an opening formed in the body; and a tapered slot formed in the body below the opening, wherein a width of the tapered slot proximate the opening is greater than the width of the tapered slot distal the opening;

anchoring at least a portion of the patch to an inner surface of the casing with an anchoring tool disposed at least partially within the patch; and expanding the patch radially outward with an expansion tool after the portion of the patch has been anchored to the inner surface of the casing.

17. The method of claim 16, wherein anchoring at least a portion of the patch to the inner surface of the casing further comprises moving a tapered wedge within the tapered slot with the anchoring tool.

18. The method of claim 17, further comprising breaking one or more shear screws that couple the tapered wedge to the anchoring tool after the portion of the patch is anchored to the inner surface of the casing.

19. The method of claim 16, further comprising injecting an adhesive into an annulus formed between an outer surface of the patch and the inner surface of the casing with an injection tool.

20. The method of claim 19, further comprising mixing an epoxy resin and a hardener together to form the adhesive when the injection tool is downhole.

* * * * *